US005890614A

United States Patent [19]

Dancyger

[11] Patent Number: 5,890,614

[45] Date of Patent: Apr. 6, 1999

[54] STACKER

[76] Inventor: Michael Dancyger, 811 W. 58th St., Los Angeles, Calif. 90037

[21] Appl. No.: 924,630

[22] Filed: Sep. 5, 1997

[51] Int. Cl.[6] ..... B65D 75/00

[52] U.S. Cl. ..... 220/23.6; 220/4.27; 220/23.86; 220/528

[58] Field of Search ..... 220/23.6, 23.83, 220/23.86, 4.26, 4.27, 528

[56] References Cited

U.S. PATENT DOCUMENTS

| | | | |
|---|---|---|---|
| 3,398,827 | 8/1968 | Laskin | 220/23.83 X |
| 5,040,681 | 8/1991 | Grusin | 220/23.6 X |
| 5,154,303 | 10/1992 | Jordan | 220/23.86 |
| 5,386,922 | 2/1995 | Jordan | 220/528 X |
| 5,441,163 | 8/1995 | Carrasco | 220/23.86 |
| 5,542,206 | 8/1996 | Lisch | 220/4.27 X |
| 5,547,098 | 8/1996 | Jordan | 220/528 X |
| 5,669,498 | 9/1997 | Fierek et al. | 220/23.83 X |
| 5,671,856 | 9/1997 | Lisch | 220/4.27 |

*Primary Examiner*—Steven M. Pollard
*Attorney, Agent, or Firm*—Andra M. Vaccaro

[57] ABSTRACT

A system comprised of trays is disclosed for converting a bucket to an organized receptacle for storing, carrying and dispensing tools and small parts or objects. Each of the trays is configured substantially as a modified circle so that it can be stacked neatly within the bucket. Each tray has partitions which divide the tray into compartments. Each tray has a partially recessed handle in the center of each tray in a configuration enabling them to be grasped readily by the fingers of a user, even when the tray is filled. Each individual tray is thereby readily removable. The trays can be stacked so that they are either recessed within the tray laying beneath it or can rest on the top edge thereof. In the preferred embodiment of the invention, the trays are provided in variable vertical dimensions with at least two of the upper trays having a pie-shaped wedge removed therefrom thereby providing for the storage of vertically elongated articles therein.

10 Claims, 8 Drawing Sheets

STACKER

BACKGROUND OF THE INVENTION

1. Field of the Invention

The present invention relates to trays which are placed within a bucket or the like, which convert a general utility bucket into an organized container and carrier for storing and transporting vertically elongated tools and small parts and other articles during and between jobs. More particularly, the present invention relates to a portable tool container.

2. Description of the Prior Art

In the construction trade, as well as in hobbies such as fishing and the like, persons use their own tools and equipment. Thus, it is frequently necessary for them to cart their equipment and tools to the site where they will be working. At the same time, these persons like to have a selection of fasteners, small parts, and like items available for their immediate use. By separating these items in to compartments containing like objects, it is easier and less time consuming for a user to retrieve a certain item.

Storing and carrying a variety of such small parts or objects and tools and making the same readily available for retrieval has been the subject of prior art patents. Such prior art systems are seen in U.S. Pat. No. 5,547,098 issued on Aug. 20, 1996, U.S. Pat. No. 5,505,331 issued on Apr. 9, 1996, U.S. Pat. No. 5,441,163 issued on Aug. 15, 1995, U.S. Pat. No. 5,386,922 issued on Feb. 7, 1995, U.S. Pat. No. D 355,735 issued on Feb. 21, 1995, U.S. Pat. No. D 354,869 issued on Jan. 31, 1995, U.S. Pat. No. 5,542,206 issued on Aug. 6, 1996, U.S. Pat. No. D 375,200 issued on Nov. 5, 1996, U.S. Pat. No. D 371,593 issued on Jul. 9, 1996, U.S. Pat. No. D 325,281, issued on Apr. 7, 1992, and U.S. Pat. No. 5,154,303, issued on Oct. 13, 1992, and U.S. Pat. No. 4,911,925, issued Mar. 27, 1990. Each of these prior art patents disclose a series of vertically stacked trays, each subdivided into compartments in which each tray has an open center with a strap or handle straddling the opening.

In each of these prior art devices a bucket-like container is used with at least one or two removable trays formed to fit into the upper end of the bucket. Generally, in the tool bucket type of device larger tools are simply stored in a loose mode in the bottom of the bucket and smaller tools and hardware are stored in the trays. The prior art tool buckets are very inconvenient because the craftsman must remove all of the upper trays at each job to gain access to the larger tools stored in a loose mode in the bottom of the bucket. Also this is inconvenient for the craftsman since he must go through the complete unloading process even if the job only requires a single screwdriver, hammer or wrench. Also, in most of these prior art tool containers there is insufficient room for large tools, such as hammers, wrenches, screwdrivers, acetylene torches and the like. Many craftspersons require such tools with a elongated vertical component as standard pieces of equipment. Prior art tool containers which are too small, or which incorporate drawers require the craftsperson to carry these other items separately. This is extremely inconvenient and, in the case of the large tool chest, may mean that the craftsperson will have to make at least two or more trips from his or her vehicle to the work site or, in the case of the tool bucket, may mean that the craftsperson will have to carry all tools with an elongated vertical component in the other hand, making it difficult to manuever. Therefore, it would be highly advantageous, therefore, to remedy the foregoing and other deficiencies inherent in the prior art.

SUMMARY OF THE INVENTION

The present invention relates to a carrying device that includes a means for carrying many different items such as tools, fasteners, drill bits, rulers, and the like, while permitting the easy transportation of these various items at the same time. The present invention also offers a means of carrying many different types and sizes of such items at the same time to various locations so that they are readily accessible.

In the device of the present invention, trays having at least three compartments are provided .Each tray is either short or tall and has a plurality of sides which when combined are substantially circular, so as to substantially fit within the interior dimension of a standard 5 gallon bucket. Radially disposed partitions are placed within the trays to form pie-shaped compartments. All of the partitions intersect at a central channel into which a partially recessed handle is placed which enables a user to grasp that tray with his or her fingers even when the tray is full of items.

In the preferred embodiment of the present invention, the tall trays are substantially circular, while the shorter trays are missing a pie-shaped wedge such that when the trays of the preferred embodiment of the present invention are vertically stacked on top of one another, tools with an elongated vertical component may be placed so that they are resting within the area created by the missing pie wedge in the shorter trays.

In addition, the present invention provides a means whereby the trays can either be stacked so that they are resting above the preceding tray, or stacked so that the bottom of the tray is resting within tray directly underneath.

Accordingly, it is an object of the present invention to provide an improved portable tool container providing means for storing and carrying tools and other objects having elongated vertical handles, such as wrenches, hammers and the like.

Another object of the present invention is to provide an improved portable tool container that is relatively simple to take apart and that can stack in a variety of different ways.

And a further object of the present invention is the provision of an improved portable tool container which is more versatile than prior art work holders.

DESCRIPTION OF PREFERRED EMBODIMENTS

Figure 1:
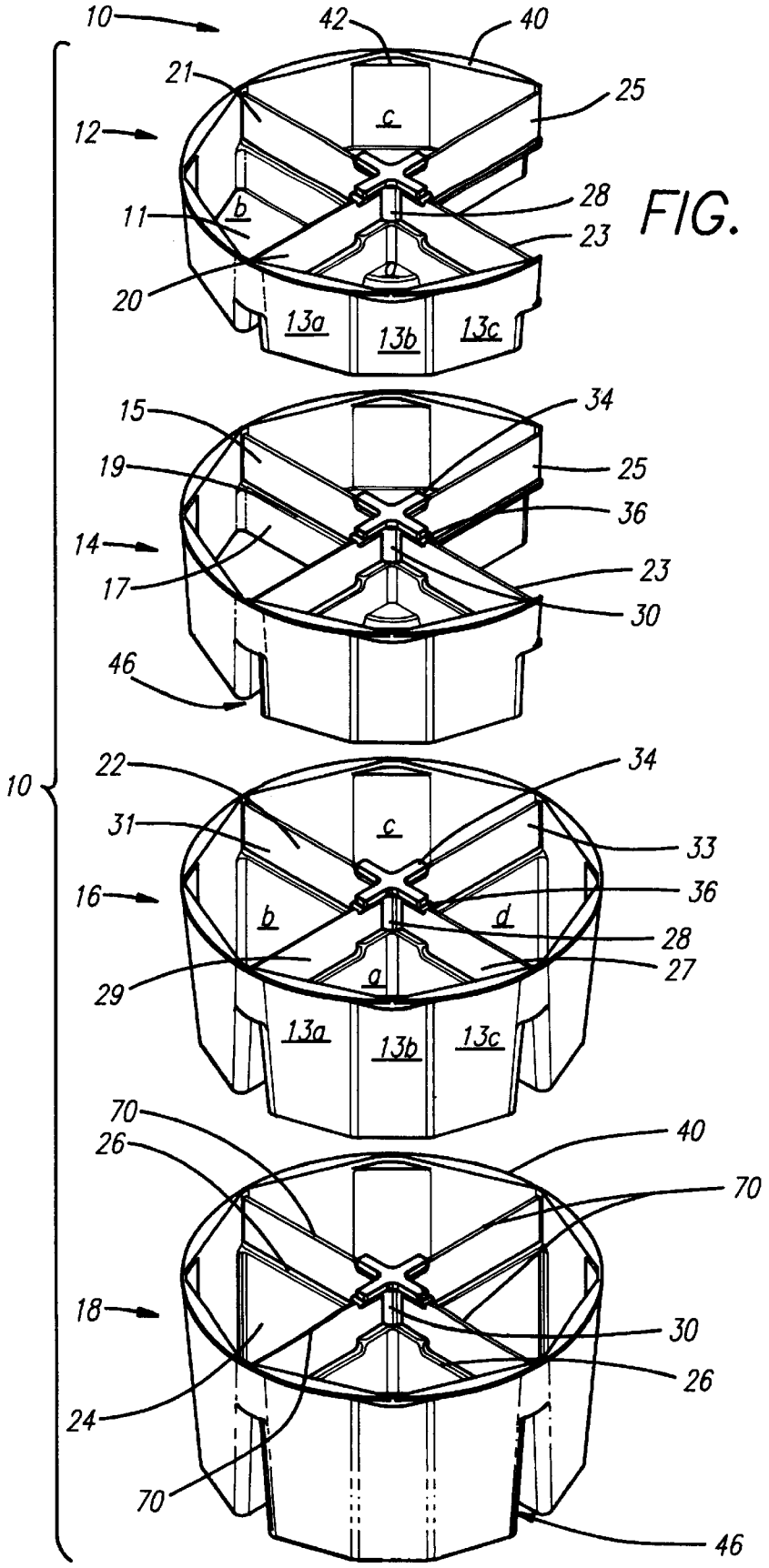
FIG. 1 is an exploded perspective view of four of the individual trays of the preferred embodiment of the present invention.
Figure 2:
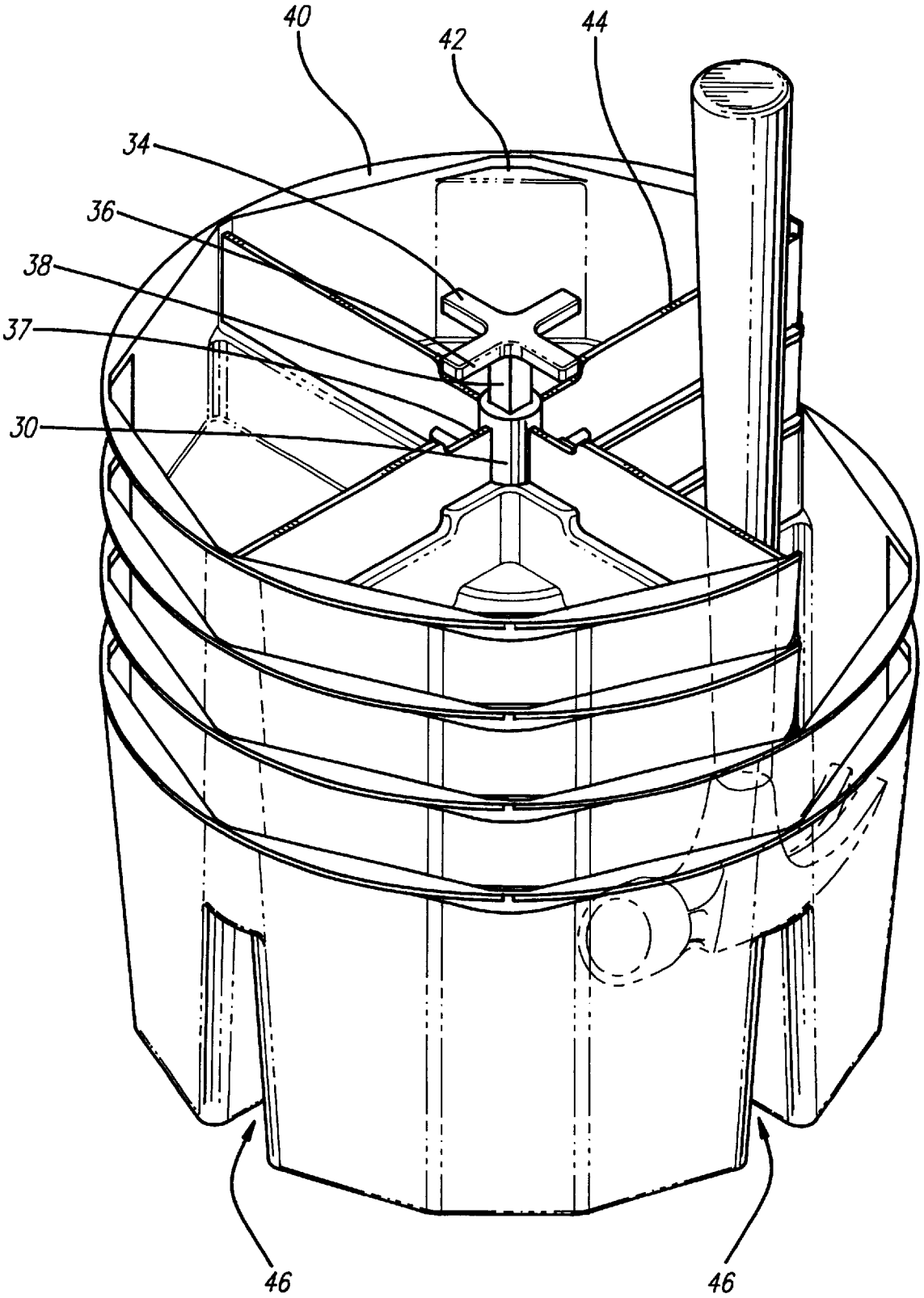
FIG. 2 is a perspective view of the preferred embodiment of the present invention in a stacked storage configuration providing for the storage of elongated vertical object therein.
Figure 3:
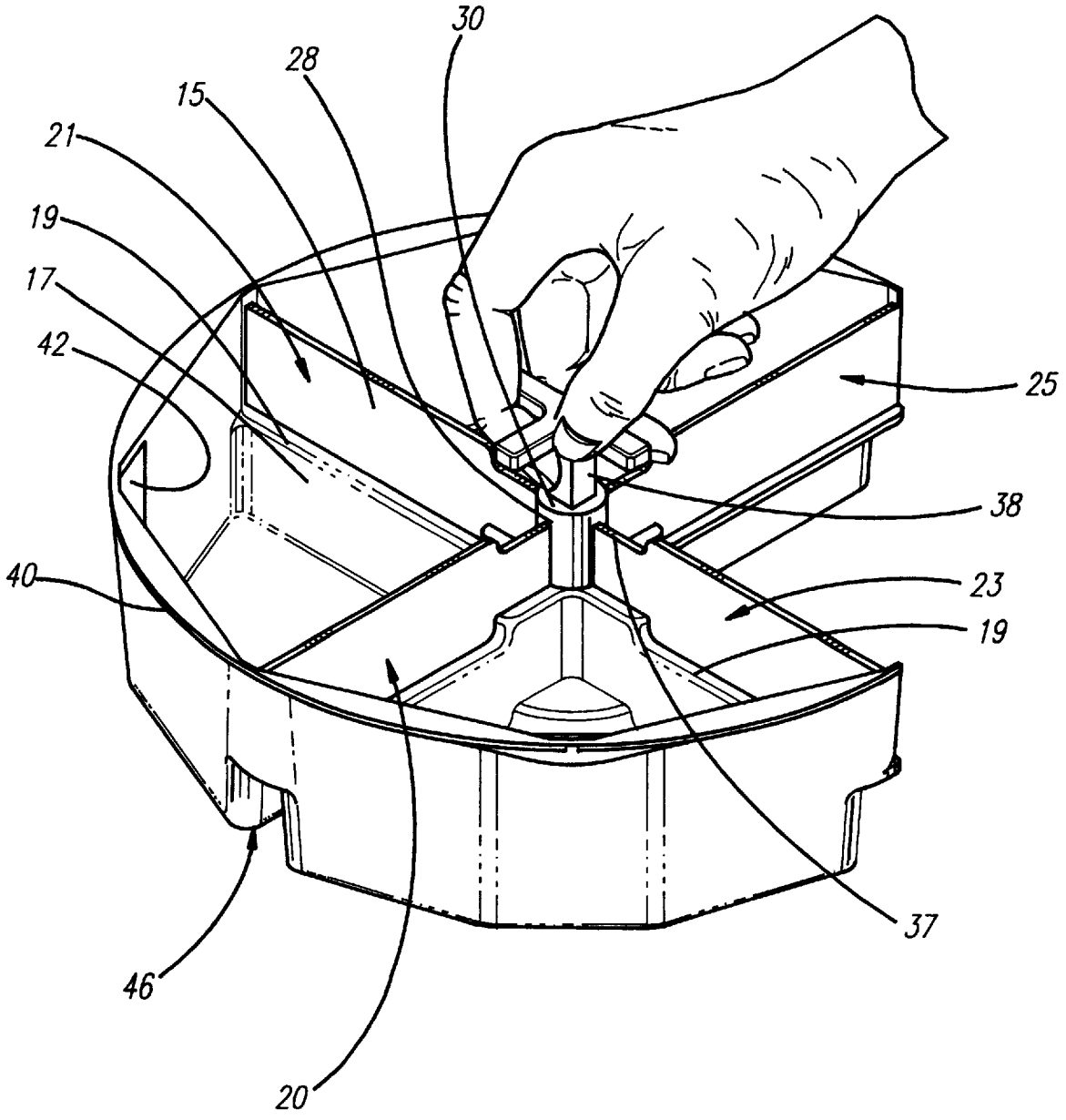
FIG. 3 is a perspective view of the use of the handle of the preferred embodiment of the present invention.
Figure 4:
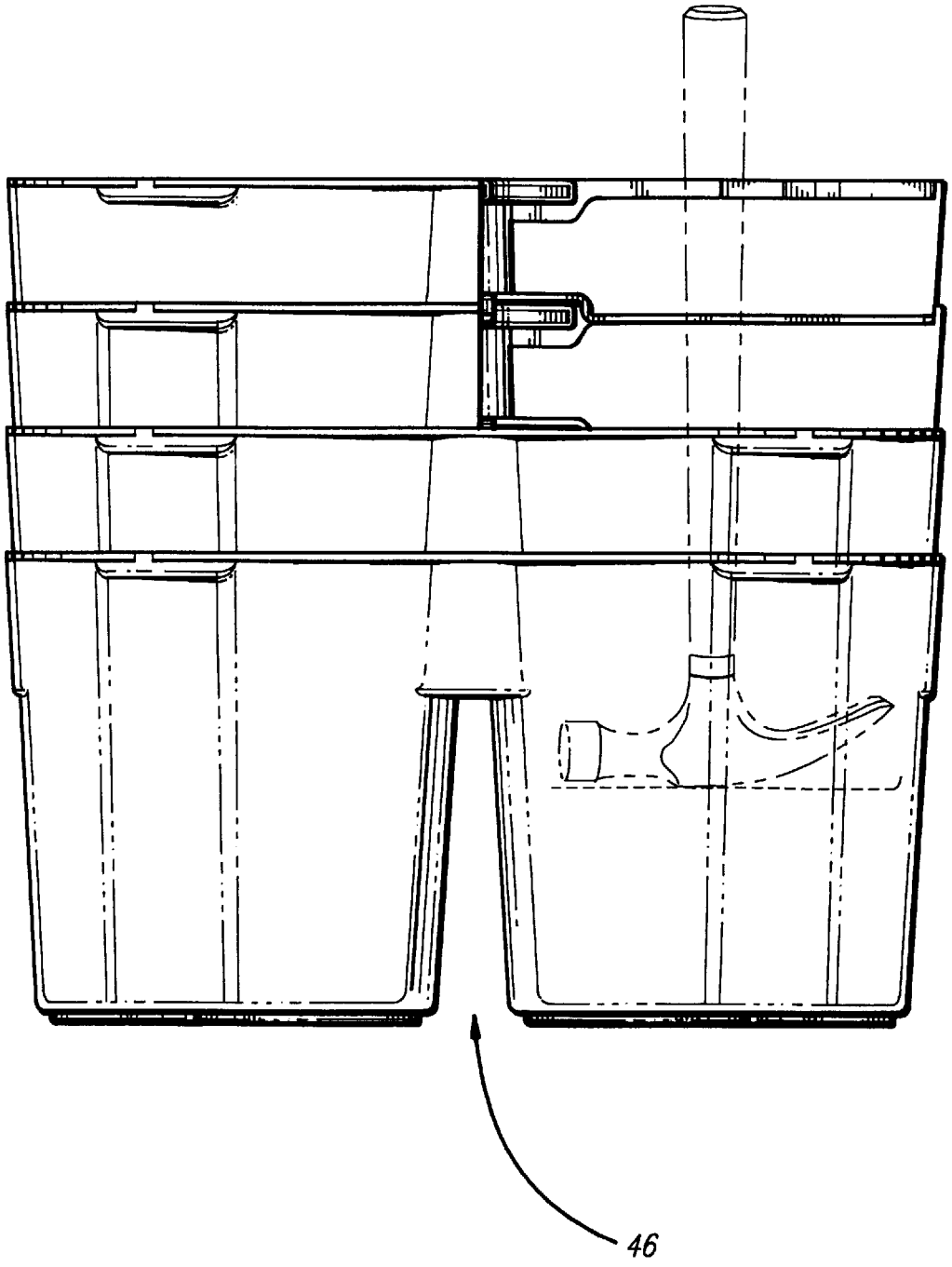
FIG. 4 is a right side elevational view of the preferred embodiment of the present invention providing for use of the tray for the storage of elongated vertical object therein.

Referring to the drawings, there is shown in FIGS. 1 through 5 the preferred embodiment of the present invention. In the preferred embodiment, device 10 comprises a plurality of trays—a top tray 12, a second tray 14, a third tray 16 and a bottom tray 18. Trays are provided in plural sizes, according to the height. In the preferred embodiment, there are low, shallower trays 12 and 14 and higher, deeper trays 16 and 18. In all respects, each of the shallower trays 12 and 14 are equivalent and interchangeable. Likewise, in all respects, each of the deeper trays 16 and 18 are equivalent and interchangeable. Shallower trays 12 and 14 are vertically shorter (less deep) than the two bottom deeper trays 16 and 18.

Each of the individual trays 12, 14, 16 and 18 is vertically stackable. Each of the deeper larger bottom trays 16 and 18 have a plurality of compartments therein denoted by the letters a, b, c and d. Each of the upper shallower trays 12 and 14 have a plurality compartments therein denoted by the letters a, b and c. Each compartment of any size tray has a floor or bottom 11 and and a vertical perimetric outer wall 13. In the preferred embodiment, the outer perimetric wall 13 comprises two equal length angled members 13*a* and 13*c* connected by a smaller flat member 13*b*.

Each of the trays 12, 14, 16 and 18, include a plurality of radially disposed partitions 70 extending between a central column 28 and the vertical perimetric outer walls 13. Partitions 70 divide the interior volume of each tray 12, 14, 16, and 18 into the plurality of compartments. In the preferred embodiment, partitions 70 of each of the trays are fixed in place; hence, the compartments defined thereby are fixed and cannot be enlarged or reduced in size.

Compartments "b" in the shallower trays 12 and 14 are bounded on both sides by partitions 20 and 21 respectfully. Compartments "a" in the shorter trays 12 and 14 are bounded on both sides by partitions 20 and 23. Compartments "c" in the shorter trays 12 and 14 are bounded on both sides by partitions 21 and 25.

Compartments "a" in the deeper trays 16 and 18 are bounded on both sides by partitions 27 and 29. Compartments "b" in the deeper trays 16 and 18 are bounded on both sides by partitions 29 and 31 respectfully. Compartments "c" in the deeper trays 16 and 18 are bounded on both sides by partitions 31 and 33. Compartments "d" in the deeper trays 16 and 18 are bounded on both sides by partitions 33 and 27.

Each of the partitions 27, 29, 31 and 33 in the deeper trays are comprised of a first flat area 22 and a second flat area 24 created by the walls of an inverted channel 46 extending through the bottom of the tray. Flat area 22 extends upward from the middle of the inverted channel 46 so as to create a shoulder 26.

Each of the partitions 20 and 21 in the shallower trays are comprised of a first flat area 15 and a second flat area 17 created by the walls of an inverted channel 46 extending through the bottom of the tray. Flat area 15 extends upward from the middle of the inverted channel 46 so as to create a shoulder 19. Partitions 23 and 25 are likewise constructed except that the outer wall of the inverted channel in the pie-shaped wedge area that has been removed does not exist, such that the compartment side of partitions 23 and 25 comprise a first flat area 15 and a second flat area 17 which is created by the remaining wall of the inverted channel. Flat area 15 extends upward from where the center of the channel would be so as to create a shoulder 19. The open side 35 of the partitions 23 and 25 only have a first flat area 15, and a shoulder 19.

All of the partitions 70 on each individual tray intersect at a central area 28 on that tray. Central area 28 comprises a channel 30. Proximate the central area 28, each of the partitions 70 are indented at the area denoted as 37 so that the bottom of a handle 32 is flush with the tops 44 of the adjacent partitions when not in use.

Handle 32 is comprised of a shaft 38 and cross members 34 and 36 which lay over indentations 37 in each of the partitions. Shaft 38 movably extends upward from channel 30 when it is being used or is located wholly within channel 30 when not in use. Cross members 34 and 36 span the top of the indentations 37 on the top of each partition. Each tray may be grasped and lifted by grabbing cross members 34 and 36 of handle 32 and pulling up on it. Even if the trays are filled with objects, the cross members 32 and 34 of handle 32 allows the user's fingers unobstructed access for grip.

Figure 5:
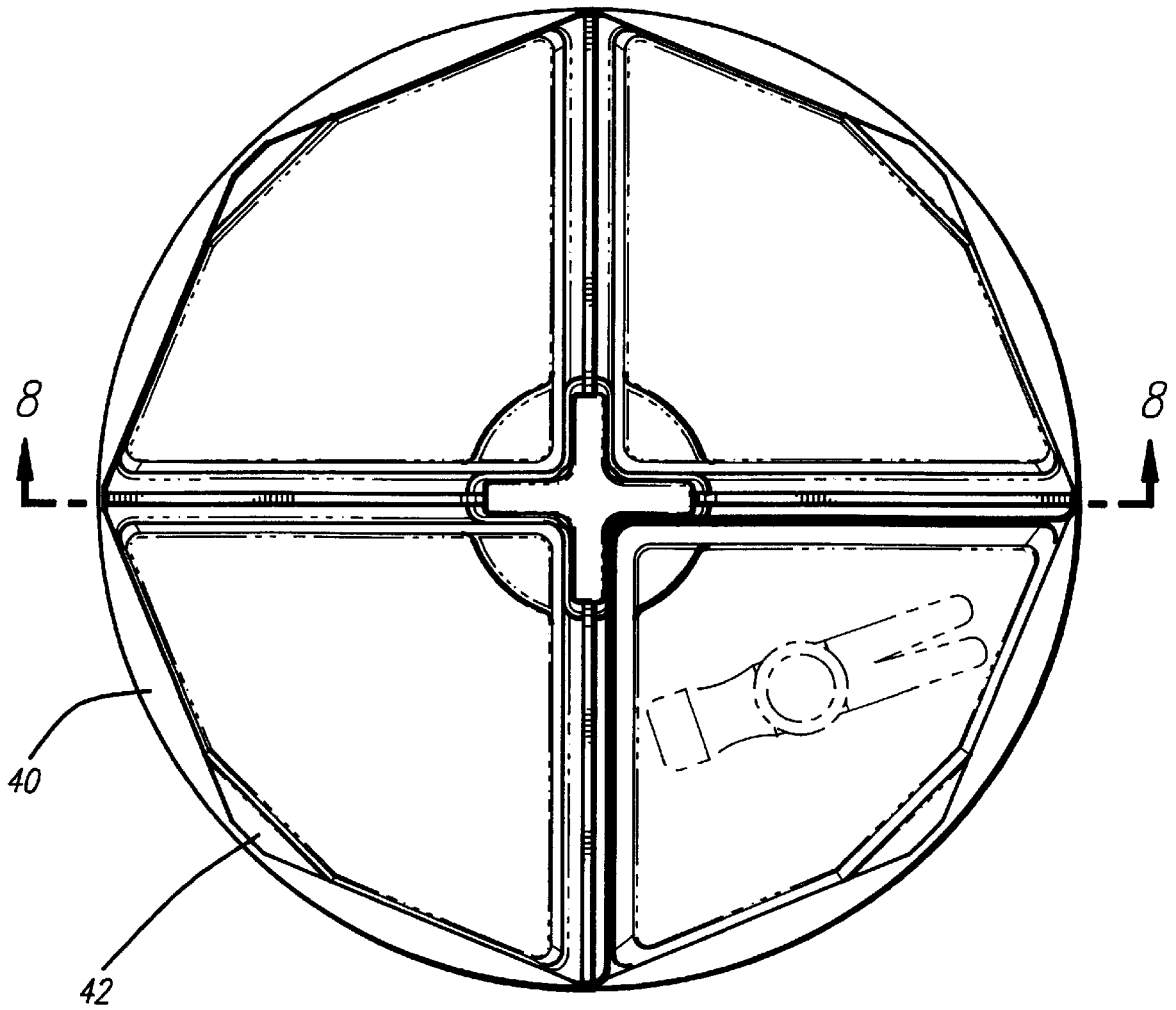
FIG. 5 is a top plan view of the present invention providing for use of the tray for the storage of elongated vertical object shown in phantom therein.

Referring more specifically to FIG. 5, each of the deeper trays 16 and 18 have a first lip 40 extending around the outside top circumference thereof. Likewise each of the shallower trays 12 and 14 have a first lip 40 extending around the outside top circumference thereof but which does not extend along the inside of the removed pie-shaped wedge. In each compartment in the same plane as the top 44 of each partition 70 are recessed ledges 42. In the preferred embodiment, the trays are 12 sided. Each of the perimetric walls of each compartment contains three parts, 13*a*, 13*b*, and 13*c*, with 13*a* and 13*c* being of equal height and width and joined together by 13*b*, which is the same width as the top of inverted channel 46.the sides, with the recessed ledge 42 attached to the middle 13*b* of the three sides.

Figure 6:
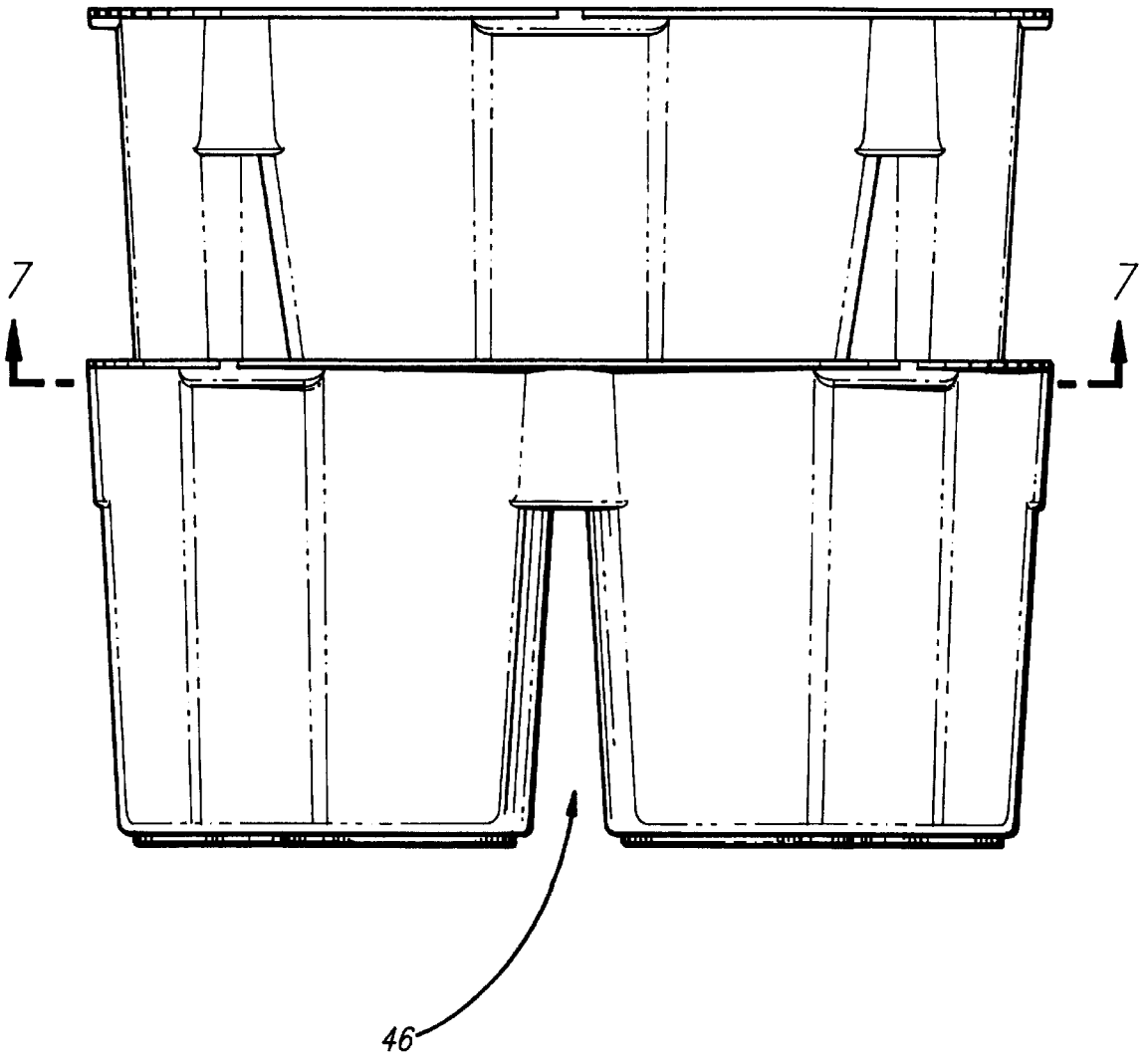
FIG. 6 is a rear elevational view of the preferred embodiment of the present invention.
Figure 7:
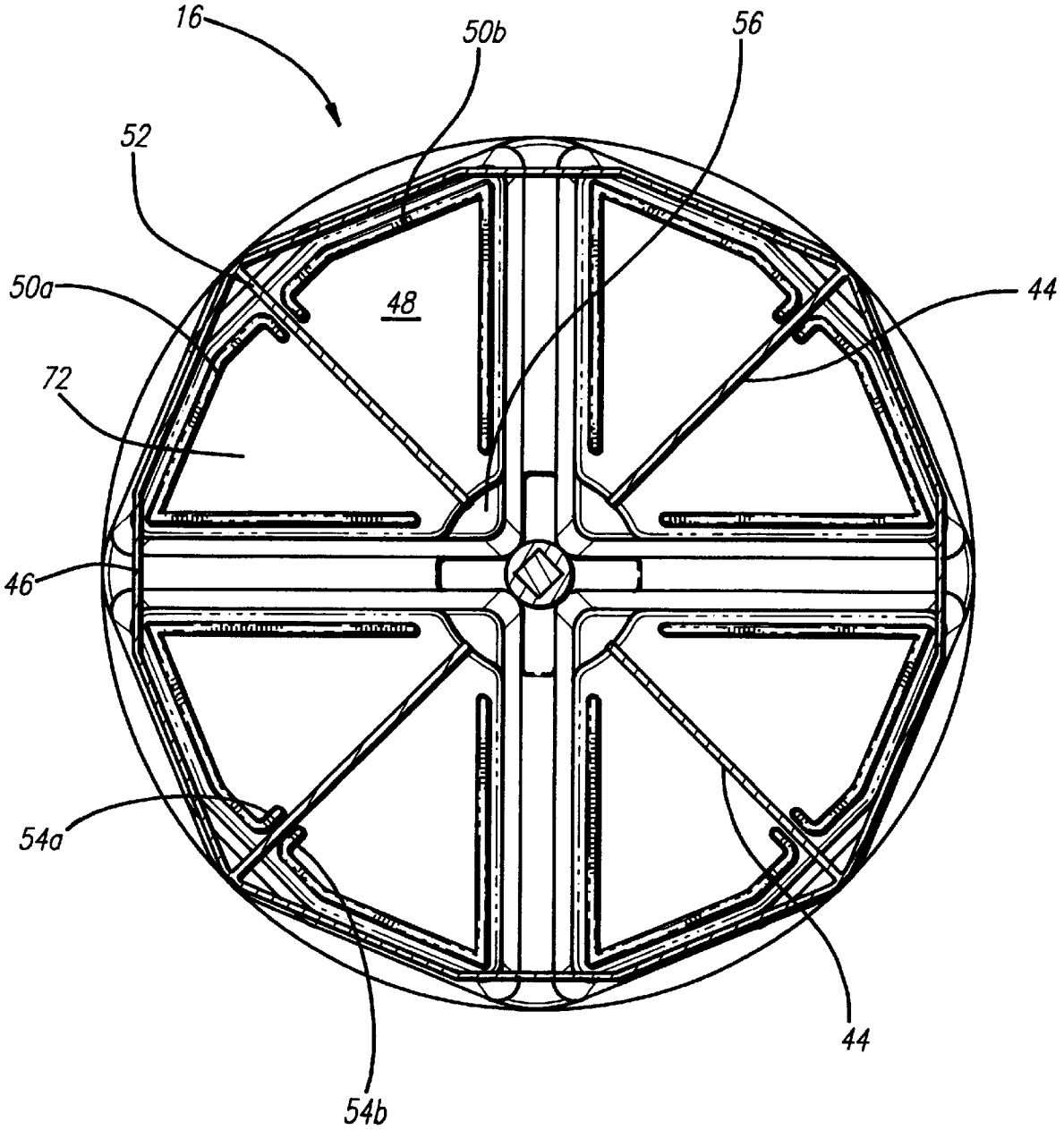
FIG. 7 is a cross sectional view taken along lines 7—7 of FIG. 6.

Referring next to FIGS. 6 and 7, each partition is created by recesses 46 fabricated into the bottom 72 of each of the individual trays. Referring more specifically to FIG. 7, which is a cross section taken along lines 7—7 of FIG. 6, the bottom 72 of tray 16 is shown, which is representative of the bottoms of the other trays with suitable modification for trays 12 and 14. The bottom of each compartment comprises a substantially flat triangular surface 48 with raised edges 50*a* and 50*b* running substantially around the perimeter. The flat surface area 48 of each compartment is recessed at apexes 56 which is proximate the center area 28. The raised edges 50*a* and 50*b* along each of the flat triangular surfaces 48 on the bottom of each compartment is separated in the middle by an area 52 having parallel raised edges 54*a* and 54*b* extending at a 90 degree angle therefrom.

Figure 8:
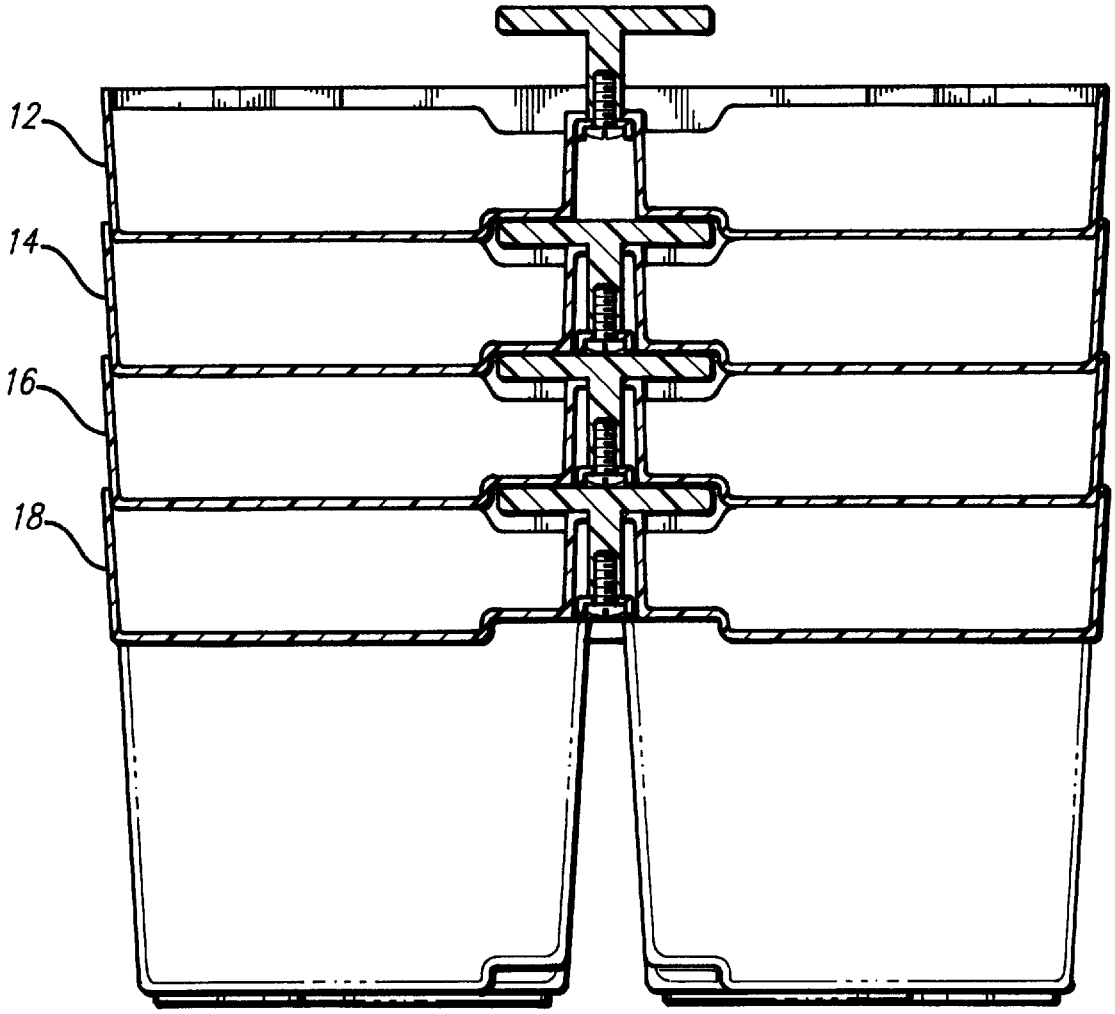
FIG. 8 is a cross sectional view taken along lines 8—8 of FIG. 5.

When used in the storage and/or carrying mode, the trays may be stacked closely together. Specifically, as shown in FIG. 8, tray 16 is placed on top of tray 18, tray 14 is placed on top of tray 16, and tray 12 is placed on top of tray 14, such that the handles 32 of the immediately preceding tray engages with and fits into the recesses 56 in the bottom of the tray installed directly above. The area in which the pie-shaped wedges are missing are placed on top of each other so as to create an area in which elongated vertical objects may be stored. In addition, the inverted channels 46 are placed over each of the corresponding partitions 70 such that the channels rest on shoulders 26 or 19, depending on which tray is being used.

Alternatively, if additional space between the various trays is desired, the trays may be stacked as shown in FIGS. 6 and 7, whereby the tops 44 of the partitions of the immediately preceding tray fit into areas 52 on the bottom of the tray installed immediately above, such that the tray directly above, rests on the partitions 70 and the ledges 42.

It is contemplated that the preferred embodiment of the present invention may be stacked vertically inside of a standard 5 gallon bucket. Trays 16 and 18 are configured so that they can occupy substantially all of the area of bucket (not shown) when considered in plan view, but still have sufficient clearance to preclude being locked therein by vacuum or friction.

It is also contemplated that the present invention can be adapted to become a storage and dispensing receptacle for craftspersons, home hobbyists, fishermen, plumbers, electricians and the like since the compartments are very convenient for handling several types of small parts or objects generally used in quantity, such as nails, screws, nuts, and similar fasteners, fishing lures, buttons, sequins, etc.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

I claim:

1. A storage container comprising:

a plurality of vertically stackable substantially round upper and lower trays, each of said trays having a top and a bottom side, wherein said upper trays are missing a pie-shaped wedge therefrom;

radially disposed intersecting partitions for dividing said trays into a plurality of compartments; each of said partitions having an upper portion, and a shoulder disposed proximate the top thereof and an inverted channel forming the bottom of the side wall of said compartments; wherein said upper portion is attached to said channel so as to create a shoulder on each side of said partition, such that said trays may be stacked by inserting said inverted channel over the upper portion of the partition of the tray stacked immediately below such that the tray stacked immediately above fits inside the tray immediately below and rests on said shoulder;

alternative stacking means for engaging said upper portions of said partitions in the tray stacked immediately below, so that the tray stacked immediately above does not fit inside the tray immediately below it; and a vertically raised handle means coupled to the intersection of said radially disposed partitions on each of said trays, said handle means capable of being raised so as to lift said tray to which it is coupled;

whereby, when said upper and lower trays are vertically stacked such that said missing pie shaped wedges in said upper trays are directly over each other, the compartment in said lower tray directly underneath said missing pie shaped areas in said upper trays provides an area for storing elongated vertical objects.

2. The storage container of claim 1 wherein each of said trays having a configuration substantially conforming to the configuration of a bucket so that each of said upper and lower trays may be vertically stacked therein.

3. The storage container of claim 1 wherein said lower trays have an outer lip along the entire upper circumference thereof and a recessed ledge beneath said outer lip on which said trays rest when said alternate means for stacking is utilized.

4. The storage container of claim 1, wherein each of said compartments comprise a first, second and third outer wall, said second outer wall comprising a ledge proximate the upper edge thereof, on which said trays rest when said alternate means for stacking is utilized.

5. The storage container of claim 1 wherein each of said handles comprise two interconnected crossmembers, a central shaft, which is movably connected to the intersection of said radially disposed partitions.

6. The storage container of claim 5 wherein each of said trays has a central column having a wall which defines a hollow center, in which said shaft of said handle is movably connected whereby said trays are readily grasped and lifted by hand when said handle is lifted upward.

7. A storage container comprising:

a plurality of vertically stackable substantially 12-sided upper and lower trays, each of said trays having a top and a bottom side, wherein each of said upper trays are missing a pie-shaped wedge therefrom;

radially disposed partitions intersecting at a central channel, said partitions dividing said trays into a plurality of compartments; each of said partitions having an upper portion, a lower portion formed by an inverted channel in the bottom of said trays, and a shoulder disposed between said upper and lower portion which is formed by the top of the channel where the upper portion connects to the lower portion, each of said partitions forming a side wall of a compartment; wherein each of said compartments comprise a first, second and third outer wall, said second outer wall having a ledge proximate the upper edge thereof, and wherein said trays may be stacked by inserting the inverted bottom channel over said partitions of said tray stacked immediately below such that said tray stacked immediately above fits inside said tray immediately below and rests on said shoulders;

alternative stacking means attached to said bottom of said trays for engaging said partitions in said tray stacked immediately below, so that said tray stacked immediately above does not fit inside said tray immediately below it and wherein said trays rest on said ledge when said alternate means for stacking is utilized;

an outer lip coupled to the uppermost circumference of each of said trays; and a handle coupled to each of said central channels, said handle comprise two interconnected crossmembers and a central shaft which is movably connected to said cnetral channel so that said handle is capable of being raised so as to lift said tray to which said handle means is coupled;

whereby, when said upper and lower trays are vertically stacked such that said missing pie shaped wedges in said upper trays are directly over each other, the compartment in said lower tray directly underneath said missing pie shaped areas in said upper trays provides an area for storing elongated vertical objects.

8. The storage container of claim 7 wherein each of said trays having a configuration substantially conforming to the configuration of a bucket so that each of said trays may be vertically stacked therein.

9. The storage container of claim 7 further comprising a means for receiving said handle coupled to the bottom of each of said trays, whereby said receiving means engages the handle of said tray immediately therebeneath.

10. The storage container of claim 7 wherein each of said partitions further comprise a recessed area proximate said central channel on which said handle lies when not in use.

* * * * *